US006231218B1

(12) United States Patent
Esprit

(10) Patent No.: US 6,231,218 B1
(45) **Date of Patent: *May 15, 2001**

(54) FISHING LIGHT

(76) Inventor: Lee O. Esprit, 1673 Basile/Eunice Hwy., Basile, LA (US) 70515

( * ) Notice: Subject to any disclaimer, the term of this patent is extended or adjusted under 35 U.S.C. 154(b) by 0 days.

This patent is subject to a terminal disclaimer.

(21) Appl. No.: 09/516,298

(22) Filed: Mar. 1, 2000

Related U.S. Application Data

(63) Continuation of application No. 09/039,572, filed on Mar. 16, 1998, now Pat. No. 6,039,464.

(51) Int. Cl.[7] ..... B63B 1/00

(52) U.S. Cl. ..... 362/477; 362/159; 362/160; 362/209; 362/266; 431/343; 431/344

(58) Field of Search ..... 362/477, 159, 362/160, 209, 266, 396; 431/343, 344, 100

(56) References Cited

U.S. PATENT DOCUMENTS

| | | | |
|---|---|---|---|
| 51,120 | 11/1865 | Quinby . | |
| 173,140 | 2/1876 | Sherman . | |
| 713,364 | 11/1902 | Uhlenhart . | |
| 756,438 | 4/1904 | Uhlenhart . | |
| 902,313 | 10/1908 | Molloy . | |
| 1,079,808 | 11/1913 | Spangenberg . | |
| 3,008,679 | 11/1961 | Powell | 248/226 |
| 3,752,108 | 8/1973 | Bovenzi | 114/221 |
| 4,587,603 | 5/1986 | Hughes | 362/427 |
| 4,709,980 | 12/1987 | Coll | 350/96.2 |
| 4,827,389 | 5/1989 | Crum | 362/388 |
| 4,856,452 | 8/1989 | Pingel | 114/364 |
| 5,335,149 | 8/1994 | Evans | 362/61 |
| 5,486,987 | 1/1996 | Fritz, Jr. | 362/226 |
| 5,508,895 | 4/1996 | Wagoner, Jr. | 362/61 |
| 5,860,410 * | 1/1999 | Hollingsworth | 126/40 |

* cited by examiner

*Primary Examiner*—Sandra O'Shea
*Assistant Examiner*—John Anthony Ward
(74) *Attorney, Agent, or Firm*—David L. Ray

(57) ABSTRACT

An apparatus for connecting a lantern and a fuel source for a lantern to a boat for attracting fish to the boat, the apparatus including an elongated pipe for conveying fuel from a fuel reservoir to a fuel-burning lantern, the elongated pipe having a first end and a second end, first end of pipe being adapted to receive a lantern, the second end of the elongated pipe being adapted to receive fuel from a fuel reservoir, and a pipe holder connected to boat for holding the elongated pipe and lantern, the pipe holder being adapted to position the lantern at a distance away from the side of the boat over the water in which the boat may be floating to attract fish to the area beneath said lantern.

13 Claims, 4 Drawing Sheets

FISHING LIGHT

This is a continuation of application Ser. No. 09/039,572, filed Mar. 16, 1998, now U.S. Pat. No. 6,034,464 now allowed.

BACKGROUND OF THE INVENTION

1. Field of the Invention

The present invention relates lights which may be attached to boats. In particular, the present invention relates to lights which may be attached to boats to attract fish. More particularly, the invention relates to apparatus for connecting lanterns to a boat in a position to attract fish.

2. Description of the Related Art

It is known in the art to attach lights to boats, and to attach lights to boats to attract fish to the boats.

Exemplary of the Patents of the related art are the following U.S. Pat. Nos. 51,120; 173,140; 713,364; 756,438; 902,313; 1,079,808; 3,008,679; 3,752,108; 4,587,603; 4,709,980; 4,827,389; 4,856,452; 5,335,149; 5,486,987; and 5,508,895.

SUMMARY OF THE INVENTION

In accordance with the present invention there is provided an apparatus for quickly and easily connecting a lantern and a fuel reservoir for a lantern to a boat for attracting fish to the boat. The apparatus includes an elongated pipe having a lantern at its distal end and a fuel reservoir at the other end, a pipe holder connected to said pipe by a pipe connector, and a member for holding and receiving said pipe holder.

The present invention has the advantage of enabling a lantern fueled by a fuel such as propane gas to be quickly and easily connected to a fishing vessel in a position extending outwardly from the fishing vessel to attract fish.

DESCRIPTION OF THE PREFERRED EMBODIMENTS

Figure 1:
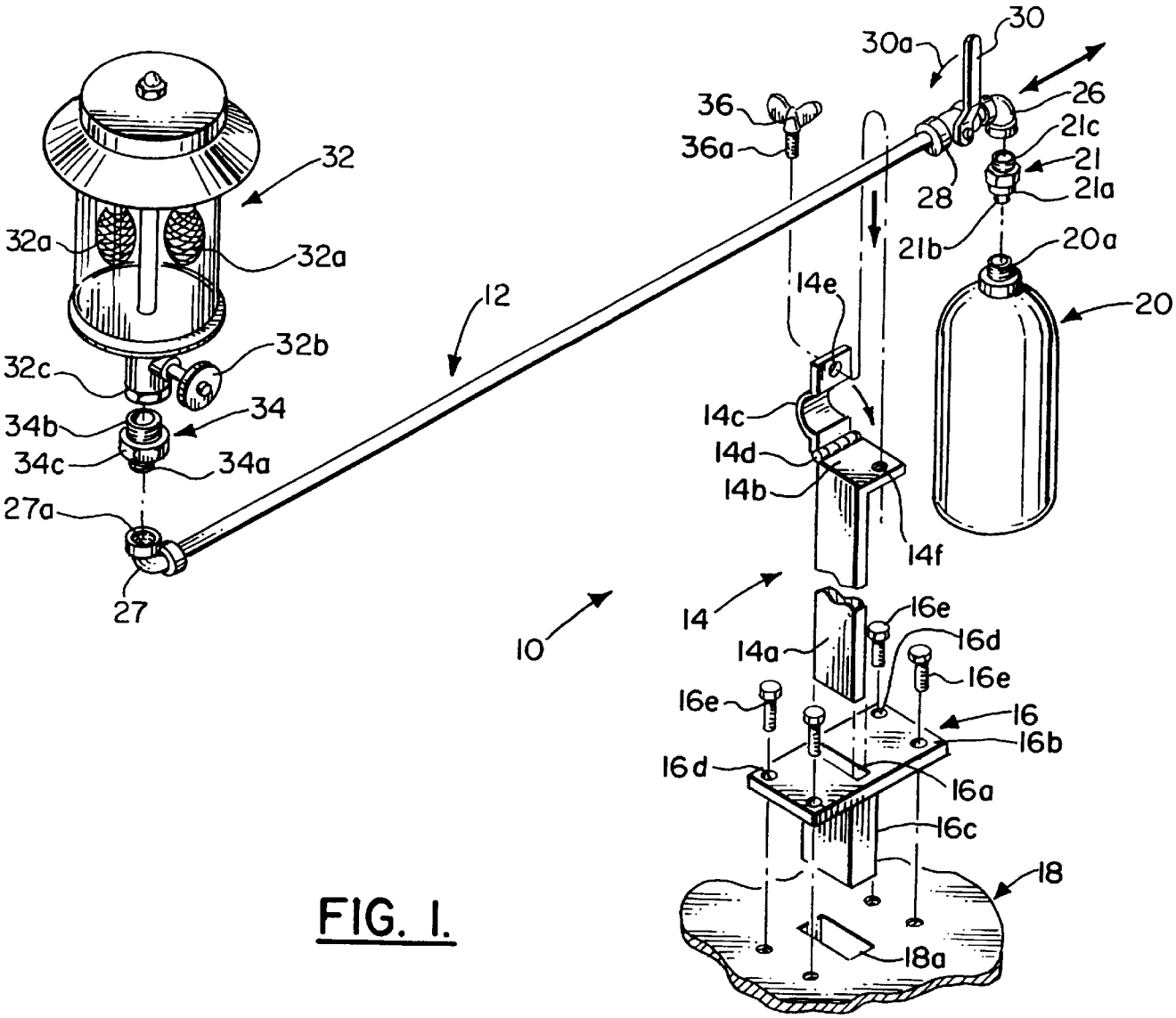
FIG. 1 is a perspective, exploded view partly cut away of the first embodiment of the fishing light of the invention.

Referring now to the drawings, in FIG. 1 is shown the first embodiment of the fishing light of the invention generally indicated by the numeral 10. Fishing light 10 includes an elongated hollow pipe generally indicated by the numeral 12 which is connected to a pipe holder assembly generally indicated by the numeral 14.

Pipe holder assembly 14 is slidably received in a deck flange generally indicated by the numeral 16. Deck flange 16 is connected to the deck generally indicated by the numeral 18 of a fishing boat.

Connected to the inner end of pipe 12 is a lantern fuel reservoir or storage vessel generally indicated by the numeral 20. Fuel storage vessel 20 may be a conventional disposable propane bottle well known in the art. Fuel storage vessel 20 as shown in the drawings is a conventional disposable propane bottle having male threads 20*a* located on the upper end thereof for threading bottle 20 into the fuel bottle fitting generally indicated by the numeral 21.

Fuel bottle fitting 21 is a conventional fitting well known in the art for connecting a conventional fuel bottle such as fuel bottle 20 to a lantern such as the lantern generally indicated by the numeral 32. Fitting 21 has a hollow cylinder 21*a* on the bottom thereof having internal female threads for receipt of male threads 20*a*. Fitting 21 also has a hollow stem 21*b* for contacting and depressing a conventional valve (not shown) located inside the male threads 20*a* of fuel storage bottle 20 to convey fuel under superatmospheric pressure from bottle 20 through hollow stem 21*b*, through fitting 21 and through the inside of male threads 21*c* to an item connected to threads 21*c* such as a lantern or the female threads of conventional pipe elbow 26. Threads 21*c* are received in female threads in pipe fitting 26. Fitting 21 has a hexagonal center section 21*c* as is well known in the art for receipt of a wrench for turning fitting 21.

Pipe elbow 26 is preferably connected to a conventional valve 28 having a valve handle 30 connected thereto for controlling the flow of fuel to lantern 32. Valve 28 has female threads (not shown) on each end thereof for receipt of male threads (not shown) on the end of pipe elbow 26 and pipe 12. Valve handle 30 may be rotated backwards and forwards 90 degrees as indicated by the arrow 30*a* in FIG. 2 to open and close valve 28. If desired, valve 28 could be omitted and the flow of fuel to lantern 32 could be regulated by valve 32*b*.

At the distal end of pipe 12 is conventional elbow fitting 27 which is preferably identical to elbow fitting 26. Lantern 32 is preferably connected to elbow fitting 27 by a conventional pipe fitting generally indicated by the numeral 34. Fitting 34 has male threads 34*a* and 34*b* at each end thereof and a hexagonal center section 34*c* as is well known in the art for receipt of a wrench for turning fitting 34. Male threads 34*a* are received in the female threads 27*a* in elbow fitting 27 and male threads 34*b* of fitting 34 are received in the conventional female threads 32*c* in the bottom of lantern 32.

Lantern 32 may be any conventional bottled gas fired lantern well known in the art. Typical lanterns are fueled by compressed gas such as propane gas contained in fuel bottle 20.

Lantern 32 preferably has two mantels 32*a* which glow brightly when ignited as is known to those skilled in the art and project an intense beam of light onto the water surrounding the boat to which the light of the invention is attached. Lantern 32 has a conventional valve 32*b* which may be rotated to control the amount of fuel flowing to lantern 32 and thereby control the intensity the light being emitted from lantern 32.

Pipe holder assembly 14 has a vertical bar 14*a* which has a pipe support member 14*b* connected at a right angle thereto. A pipe clamp 14*c* is connected by hinge 14*d* to pipe support member 14*b*. Pipe clamp 14*c* has a hole 14*e* therein for receipt of wing nut 36. Pipe support member 14*b* has a threaded hole 14*f* therein for receipt of threads 36*a* of wing nut 36.

To connect pipe 12 to pipe holder assembly 14, pipe 12 is placed onto pipe support member 14*b* and pipe clamp 14*c* is rotated thereover. Wing nut 36 is then placed through hole 14*e* and threaded into hole 14*f* to secure pipe 12 to 14.

Figure 2:
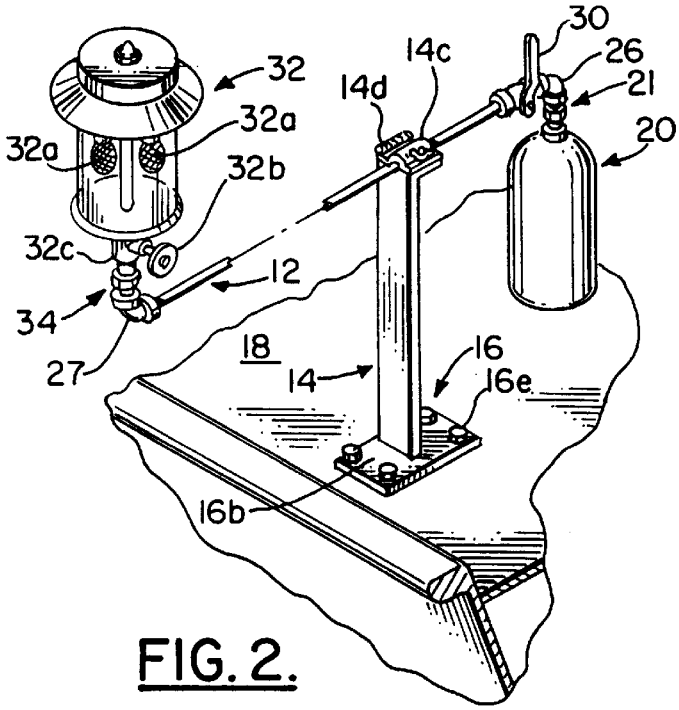
FIG. 2 is a perspective partly cut away view of the fishing light of the invention attached to a boat.

Connected to the deck 18 of the boat generally indicated by the numeral 38 in FIG. 2 is deck flange 16. Deck flange 16 has a slot or opening 16*a* in the top thereof for slidable receipt of vertical bar 14*a*. Slot 16*a* is located in horizontal plate 16*b* of deck flange 16.

Located beneath horizontal plate 16*b* of deck flange 16 in alignment therewith is sleeve 16*c* which receives vertical bar 14*a*. Plate 16*b* has a plurality of holes 16*d* therein for receipt of screws or bolts 16*e* which fasten deck flange 16 to the deck 18 of bolt 38. A slot 18*a* is located in deck 18 for receipt of sleeve 16*c*.

It can thus be seen that after deck flange 16 is mounted to the deck 18 of a bolt 38 the fishing light apparatus of the invention can be quickly and easily connected to the deck flange 16.

Figure 3:
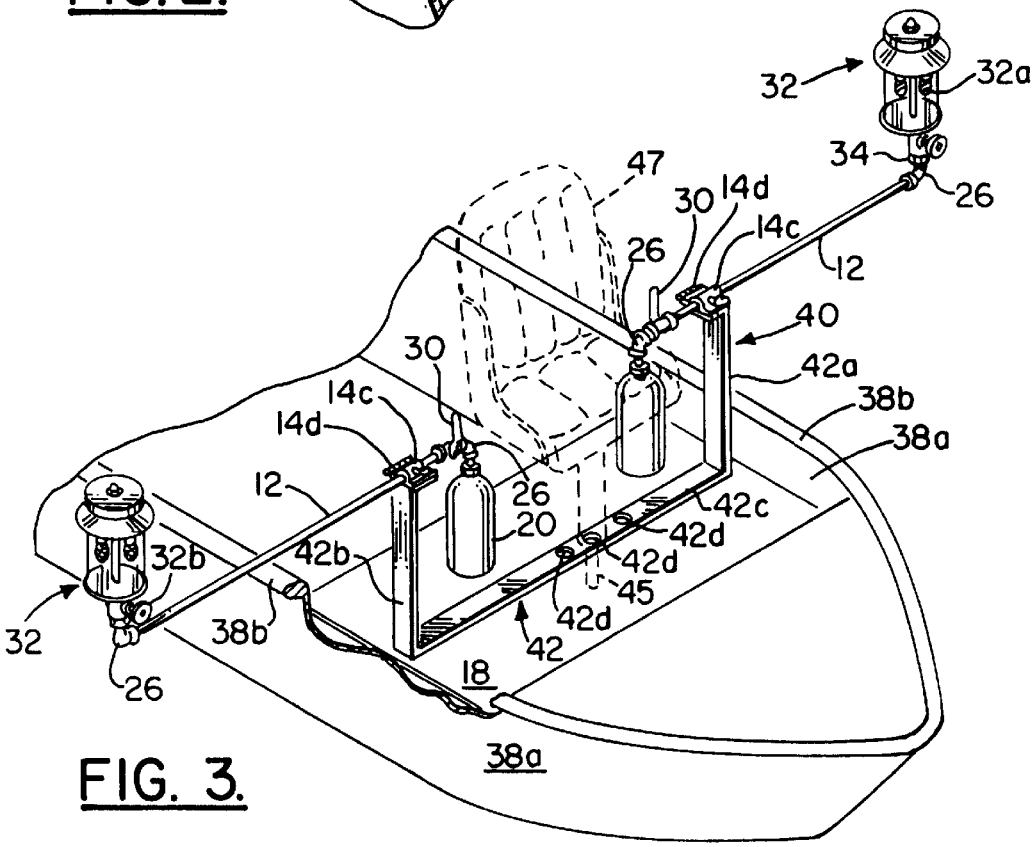
FIG. 3 is a perspective partly cut away view of the second embodiment of the invention showing the fishing light of the second embodiment connected to a boat.

In FIG. 3 is shown a second embodiment of the fishing light of the invention generally indicated by the numeral 40. In the second embodiment of the invention pipe holder assembly 14 is replaced by a U-shaped pipe holder assembly generally indicated by the numeral 42. U-shaped pipe holder assembly 42 has two parallel vertical bars 42*a* and 42*b* which are identical in size and shape. Vertical bars 42*a* and 42*b* are rigidly connected to horizontal bar 42*c*.

Horizontal bar 42*c* has a plurality of holes 42*d* therein for receipt of a boat seat pedestal 44 shown in phantom lines in FIG. 3. Boat seat pedestal 44 is a conventional boat seat pedestal well known in the art which is used to support a seat 47 in which the fisherman sits. Boat seat pedestal 44 is slidably received in a cylindrical sleeve 45 located in the deck 18 of the boat. The remainder of the components of the invention are the same and are numbered by the same numerals as the embodiments shown in FIGS. 1 and 2.

Pipe 12 preferably has a length ranging from two to four feet so that the lantern 32 is displaced outwardly from the side or gunwale of boat 38 a distance sufficient to enable the light being emitted from lantern 32 to strike the water adjacent to boat 38 and attract fish to the vicinity of boat 38. Furthermore, as can be seen in the drawings, the holding devices for holding pipe 12 are located near the sides 38*a* or gunwales 38*b* of boat 38.

U-shaped pipe holder assembly 42 has the advantage of holding two lanterns 32–32 on each side of boat 38 as shown in FIG. 3. Furthermore, U-shaped pipe holder assembly 42 is quickly and easily connected to boat 38 by simply removing seat 47 and pedestal 44, placing one of the holes 42*d* of horizontal bar 42*c* of U-shaped pipe holder assembly 42 over the hole (not shown) in the deck 18 above sleeve 45 shown in FIG. 3, and inserting pedestal 44 through hole 42*d* of horizontal bar 42*c* into sleeve 45.

Figure 4:
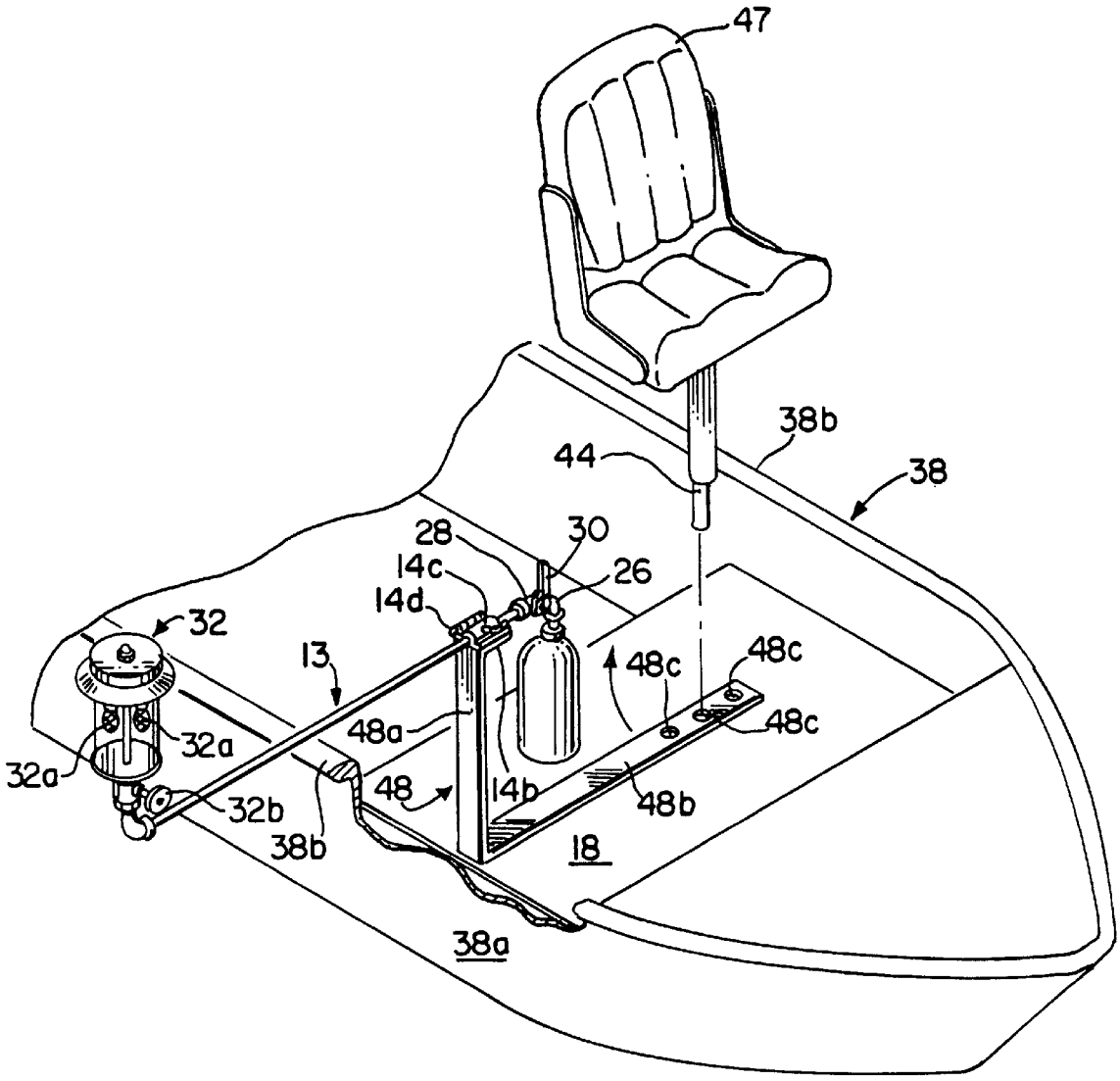
FIG. 4 is a third embodiment of the invention showing the fishing light of the invention connected to the boat.

In FIG. 4 is shown a third embodiment of the invention having an L-shaped pipe holder assembly generally indicated by the numeral 48. L-shaped pipe holder assembly 48 a vertical bar 48*a* rigidly connected to horizontal bar 48*b*. Horizontal bar 48*b* has a plurality of holes 48*c* therein for receipt of a boat seat pedestal 44.

The remainder of the components of the invention are the same and are numbered by the same numerals as the embodiments shown in FIG. 3. L-shaped pipe holder assembly 48 has the advantage of holding a single lantern 32 on one side of boat 38 as shown in FIG. 4. L-shaped pipe holder assembly 48 is quickly and easily connected to boat 38 by simply removing seat 47 and pedestal 44, placing one of the holes 48*c* of horizontal bar 48*b* of L-shaped pipe holder assembly 48 over the hole (not shown) in the deck 18 above sleeve 45 shown in FIG. 3, and inserting pedestal 44 through hole 48*c* of horizontal bar 48*b* into sleeve 45.

Figure 5:
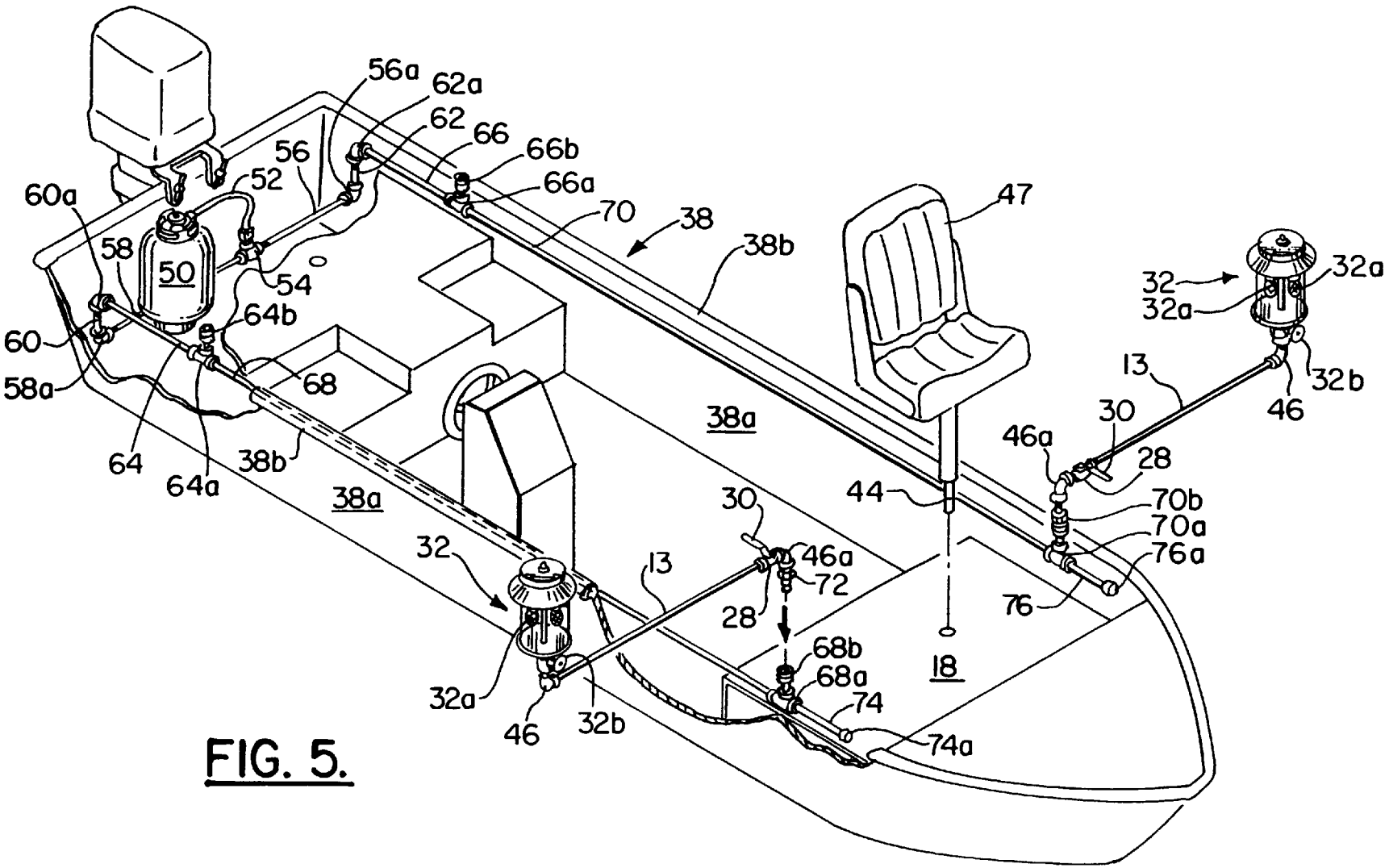
FIG. 5 is a perspective view partly cut away of a fourth embodiment of the invention showing fishing lights connected to a boat.

A fourth embodiment of the invention is shown in FIG. 5 wherein fuel conveying pipes and lantern holders are permanently attached to boat 38. The embodiment shown in FIG. 5 employs a single source of fuel which can be a large bottle of propane gas generally indicated by the numeral 50.

Propane gas bottle 50 is placed in the preferably in the rear or stern of boat 38. A gas line 52 which may be flexible is connected to a conventional T-shaped pipe fitting 54. Two fuel conveying pipes 56 and 58 are connected to fitting 54 and extend in opposite directions therefrom. Pipes 56 and 58 are connected by conventional elbow pipe fittings 56*a* and 58*a*, respectively, to two vertical fuel conveying pipes 62 and 60, respectively. Vertical pipes 60 and 62 are connected by elbow fitting 60*a* and 62*a* to two horizontal pipes 64 and 66, respectively. Pipes 64 and 66 each have a conventional T-shaped pipe fitting 64*a* and 66*a*, respectively, connected thereto, having horizontal pipes 68 and 70, respectively, extending horizontally therefrom.

Extending upwardly from T-shaped pipe fittings 64*a* and 66*a* preferably are conventional pipe couplings referred to in the art as "quick connect" couplings 64*b* and 66*b*. Quick connect couplings are well known to those skilled in the art and are used to connect a fuel source to a fuel user quickly and without leakage. Furthermore, no fuel can leak from the quick connect coupling when fuel pressure is applied thereto.

Horizontal pipes 68 and 70 may be secured to the sides or gunwale of boat 38 by any conventional methods known in the art such as clamping, bolting, tying, gluing or the like. Pipes 68 and 70 extend down the length of the sides of boat 38 to two T-shaped pipe fittings 68*a* and 70*a*, respectively. Extending upwardly from T-fittings 68*a* and 70*a* are conventional quick connect couplings 68*b* and 70*b*, respectively.

Each of the couplings 68*b* and 70*b*, and couplings 64*b* and 66*b*, can receive a male fitting 72 which extends downwardly from elbow 46*a*. Elbow 46*a* is connected to valve 28 as shown in FIG. 5. Valve 28 regulates the flow of fuel through pipe 12 to lantern 32 as explained above.

Extending outwardly from fittings 68*a* and 70*a* are pipes 74 and 76, respectively. Pipes 74 and 76 have caps 74*a* and 76*a* on the ends thereof to prevent leakage of fuel therefrom.

It can thus be seen that the embodiment shown in FIG. 5 provides for a permanent connection of piping and fittings which enable up to four lanterns to be extended from the sides of a boat 38. Furthermore, the embodiment of FIG. 5 utilizes a single large reservoir of fuel 50 for supplying fuel to all of the lanterns 32 to be utilized. The lantern and pipe assemblies can be quickly connected to the pipes and up to four lanterns may be utilized as desired.

Figure 6:
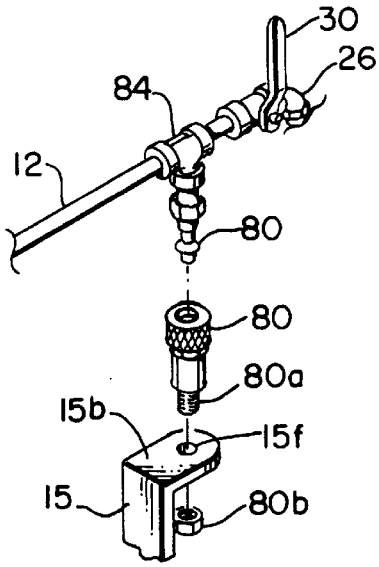
FIG. 6 is a perspective partly cut away exploded view of a connector for the fishing light of the invention.

In FIG. 6 is shown an alternate connecting embodiment of the invention which may be utilized with pipe holder assembly 14 or pipe holder assembly 42 to replace clamp 14*c*. In the embodiment shown in FIG. 6 a quick connect coupling 80 connected to the pipe holder assembly generally indicated by the numeral 15 is used as a mechanical fitting only to support the lantern 32 and pipe 12 assembly. Quick connect coupling 80 is connected to pipe support member 15*b* by extending the threaded base 80*a* of coupling 80 through hole 15*f* and fastening a nut 80*b* thereto. Quick connect coupling 80 receives a vertically oriented male fitting 82 which is connected to T-shaped pipe fitting 84. Fitting 82 is plugged to prevent the flow of fuel therethrough. The embodiment of FIG. 6 may be used in place of hinges 14*d* and clamps 14*c*.

Although the preferred embodiments of the invention have been described in detail above, it should be understood that the invention is in no sense limited thereby, and its scope is to be determined by that of the following claims:

What is claimed is:

1. An apparatus for connecting a lantern and a fuel source for a lantern to a boat for attracting fish to the boat, the apparatus comprising:

a. an elongated pipe for conveying fuel from a fuel reservoir to a fuel-burning lantern, said pipe having a first end and a second end, said first end of said pipe being adapted to receive a lantern, said second end of said pipe being adapted to receive a fuel reservoir, said pipe has a valve therein for controlling the rate of flow of fuel through said pipe, b. a pipe holder connected to said boat for holding said elongated pipe, lantern, and said reservoir, said pipe holder being adapted to position said lantern at a distance away from the side of said boat over the water in which said boat may be floating to attract fish to the area beneath said lantern, and c. a base member is connected to said boat for receiving and holding said pipe holder.

2. The apparatus of claim 1 wherein said base member has a sleeve therein for receipt of said pipe holder.

3. The apparatus of claim 2 wherein said base member is connected to the deck of said boat.

4. The apparatus of claim 3 wherein said base member is located adjacent to the gunwale of said boat.

5. The apparatus of claim 3 wherein said pipe holder extends vertically upward from said base member.

6. The apparatus of claim 5 wherein the upper end of said pipe holder has a clamp connected thereto for engaging and holding said pipe.

7. The apparatus of claim 5 wherein the upper end of said pipe holder has a quick-connect coupling connected thereto for receiving and engaging said pipe, and said pipe has a fitting thereon for receipt by said quick-connect coupling.

8. The apparatus of claim 2 wherein said pipe holder has a vertical bar extending upwardly from the deck of said boat, said vertical bar having an upper end and a lower end, said pipe being connected to said upper end.

9. The apparatus of claim 8 wherein said lower end of said vertical bar is connected to a horizontal member.

10. The apparatus of claim 9 wherein said horizontal member has two ends, vertical bar being connected at one end, and a second vertical bar identical to said vertical bar being connected to said other end of said horizontal member.

11. An apparatus for connecting a lantern to a boat for attracting fish to the boat, the apparatus comprising:

a. an elongated pipe for conveying fuel from a fuel reservoir to a fuel-burning lantern, said pipe having a first end and a second end, said first end of said pipe being adapted to receive a lantern, said second end of said pipe being adapted to receive a fuel reservoir, b. a pipe holder connected to said boat for holding said elongated pipe and said lantern, said pipe holder being adapted to position said lantern at a distance away from the side of said boat over the water in which said boat may be floating to attract fish to the area beneath said lantern, and c. a fuel reservoir located in said boat, and a fuel line connects said fuel reservoir to said pipe.

12. The apparatus of claim 11 said pipe holder is a quick-connect coupling connected for receiving and engaging said elongated pipe, and said elongated pipe has a fuel conveying fitting thereon for receipt by said quick-connect coupling and for receipt of fuel from said quick-connect coupling.

13. The apparatus of claim 12 wherein said pipe has a valve therein for controlling the rate of flow of fuel through said pipe.

* * * * *